US008980805B2

(12) United States Patent
Doyen et al.

(10) Patent No.: US 8,980,805 B2
(45) Date of Patent: Mar. 17, 2015

(54) MARINE LUBRICANT FOR FUEL OIL HAVING HIGH AND LOW SULPHUR CONTENTS

(75) Inventors: Valérie Doyen, Four (FR); Denis Lancon, Chassieu (FR); Jean-Marie Bourmaud, Luzinay (FR); Florence Bredon, Oullins (FR)

(73) Assignee: Total Marketing Services, Puteaux (FR)

( * ) Notice: Subject to any disclaimer, the term of this patent is extended or adjusted under 35 U.S.C. 154(b) by 887 days.

(21) Appl. No.: 12/445,255

(22) PCT Filed: Oct. 5, 2007

(86) PCT No.: PCT/FR2007/001629

§ 371 (c)(1),
(2), (4) Date: Mar. 11, 2010

(87) PCT Pub. No.: WO2008/043901

PCT Pub. Date: Apr. 17, 2008

(65) Prior Publication Data

US 2010/0167969 A1 Jul. 1, 2010

(30) Foreign Application Priority Data

Oct. 11, 2006 (EP) ..... 06291590

(51) Int. Cl.
*C10M 169/04* (2006.01)
*B21B 45/02* (2006.01)
*C10M 163/00* (2006.01)

(52) U.S. Cl.
CPC ..... *C10M 163/00* (2013.01); *C10M 2207/021* (2013.01); *C10M 2207/028* (2013.01); *C10M 2207/26* (2013.01); *C10M 2207/262* (2013.01); *C10M 2215/086* (2013.01); *C10M 2215/28* (2013.01); *C10M 2219/046* (2013.01); *C10N 2210/01* (2013.01); *C10N 2210/02* (2013.01); *C10N 2230/04* (2013.01); *C10N 2230/52* (2013.01); *C10N 2240/102* (2013.01); *C10N 2240/105* (2013.01)
USPC ..... 508/287; 508/583

(58) Field of Classification Search
CPC ..... C10M 139/04; C10M 139/06
USPC ..... 508/287
See application file for complete search history.

(56) References Cited

U.S. PATENT DOCUMENTS

| | | | | |
|---|---|---|---|---|
| 3,178,368 | A | 4/1965 | Hanneman | |
| 6,528,459 | B1 | 3/2003 | Roman | |
| 7,851,421 | B2 | 12/2010 | Shaw et al. | |
| 2001/0003734 | A1 * | 6/2001 | Dunn | 508/197 |
| 2002/0155958 | A1 * | 10/2002 | Dunn et al. | 508/398 |
| 2004/0171501 | A1 | 9/2004 | Leeuwen | |
| 2005/0153848 | A1 | 7/2005 | Bell et al. | |
| 2008/0287329 | A1 | 11/2008 | Lancon et al. | |

FOREIGN PATENT DOCUMENTS

| | | | |
|---|---|---|---|
| EP | 0 008 193 | | 2/1980 |
| EP | 1229 101 | | 8/2002 |
| EP | 1418220 | A2 | 5/2004 |
| EP | 1 630 223 | | 3/2006 |
| JP | H0423894 | A | 1/1992 |
| JP | 2002371292 | A | 12/2002 |

OTHER PUBLICATIONS

Eyres, Alban et al.; "Key Parameters in Cylinder Oil Performance and Crosshead Diesel Lubrication;" International Congress on Combustion Engines, XP009041263, May 15, 1995; pp. 1-17.

* cited by examiner

*Primary Examiner* — Prem C Singh
*Assistant Examiner* — Francis C Campanell
(74) *Attorney, Agent, or Firm* — Harness, Dickey & Pierce, P.L.C.

(57) ABSTRACT

The present invention for a two-stroke marine engine, which can be used with both high-sulphur content fuel oils and low-sulphur content fuel oils. It relates to a cylinder lubricant having a BN determined according to the standard ASTM D-2896 greater than or equal to 40 milligrams of potash per gram of lubricant, comprising a lubricant base stock for marine engines and at least one overbased detergent based on alkali metals or alkaline-earth metals, characterized in that it also contains a quantity of 0.01% to 10% preferably 0.1% to 2% by weight relative to the total weight of the lubricant, of one or more (A) compounds chosen from the primary, secondary or tertiary monoalcohols the alkyl or alkylene chain of which is saturated or unsaturated, linear or branched and comprises at least 12 carbon atoms. This lubricant has a sufficient neutralization capacity vis-à-vis the sulphuric acid formed during the combustion of high-sulphur fuel oils, while limiting the formation of deposits during the use of low-sulphur fuel oils.

17 Claims, 1 Drawing Sheet

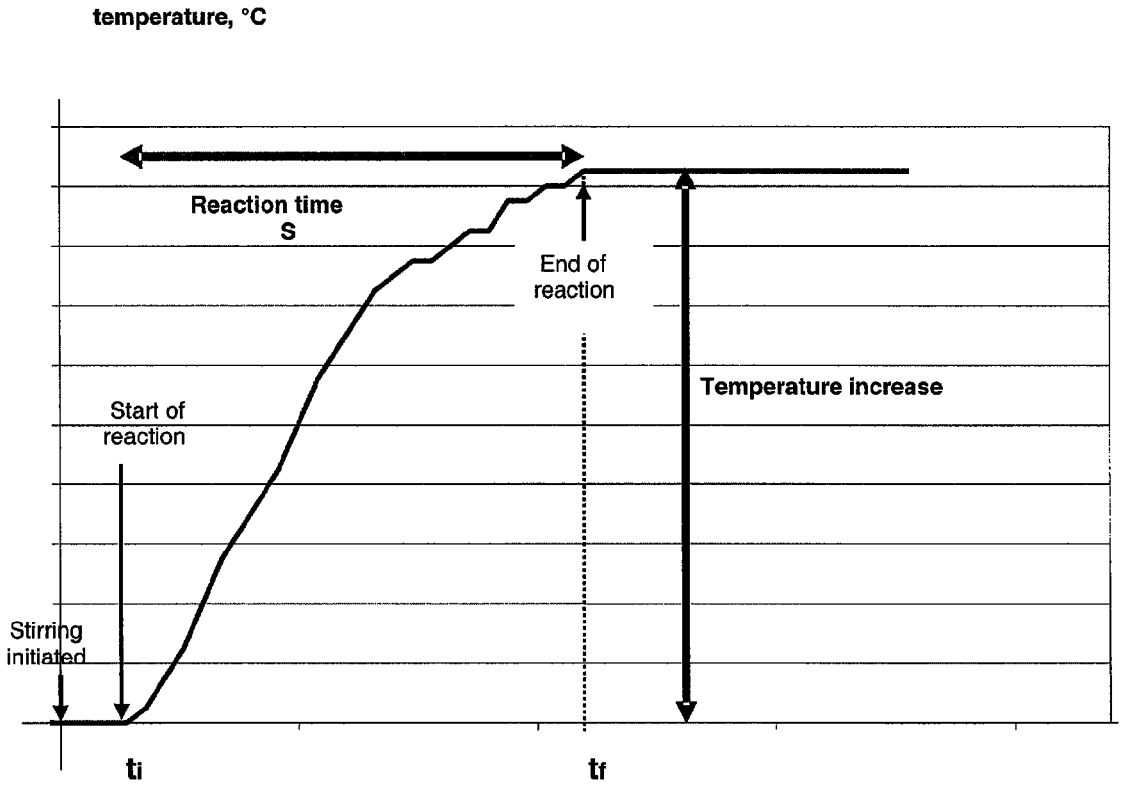
temperature, °C
Reaction time
s
End of
reaction
Temperature increase
Start of
reaction
Stirring
initiated
ti
tf

MARINE LUBRICANT FOR FUEL OIL HAVING HIGH AND LOW SULPHUR CONTENTS

CROSS-REFERENCE TO RELATED APPLICATIONS

This application is a National Phase Entry of International Application No. PCT/FR2007/001629, filed Oct. 5, 2007, which claims priority to European Patent Application No. 06291590.5, filed Oct. 11, 2006, both of which are incorporated herein by reference.

BACKGROUND

1. Field

The present invention relates to a cylinder lubricant for a two-stroke marine engine, which can be used with both high-sulphur content fuel oils and low-sulphur content fuel oils. It relates more particularly to a lubricant having a sufficient neutralizing power vis-à-vis sulphuric acid formed during the combustion of high-sulphur fuel oils, whilst limiting the formation of deposits during the use of low-sulphur fuel oils.

2. Technological Background of the Invention

The marine oils used in 2-stroke slow-speed crosshead engines, are of two types. Cylinder oils on the one hand, ensuring the lubrication of the cylinder piston assembly, and system oils on the other hand, ensuring the lubrication of all the moving parts outside the cylinder piston assembly. Within the cylinder piston assembly, the combustion residues containing acid gases are in contact with the lubricant oil. The acid gases are formed from the combustion of the fuel oils; they are in particular sulphur oxides ($SO_2$, $SO_3$), which are then hydrolyzed during contact with the moisture content present in the combustion gas and/or in the oil. This hydrolysis produces sulphurous ($HSO_3$) or sulphuric ($H_2SO_4$) acid.

In order to preserve the surface of the jackets and avoid excessive corrosive wear, these acids must be neutralized, which is generally carried out by reaction with the basic sites included in the lubricant. The neutralizing capacity of an oil is measured by its BN or Base Number, which characterizes its basicity. It is measured according to the standard ASTM D-2896 and is expressed in equivalents by weight of potash per gram of oil or mg KOH/g. The BN is a standard criterion making it possible to adjust the basicity of the cylinder oils to the sulphur content of the fuel oils used, in order to be able to neutralize all of the sulphur contained in the fuel, and capable of being converted to sulphuric acid by combustion and hydrolysis. Thus, the higher the sulphur content of a fuel oil, the higher the BN of a marine oil must be. This is why BNs varying from 5 to 100 mg KOH/g are to be found on the marine oils market.

Environmental concerns have led, in certain areas and in particular coastal areas, to requirements for the limitation of the sulphur level in the fuel oils used on ships. Thus, the regulation MARPOL Annex 6 (Regulations for the Prevention of air pollution from ships) of the IMO (International Maritime Organization) entered into force in May 2005. It provides for a maximum sulphur content of 4.5% m/m of the heavy fuel oils as well as the creation of sulphur oxide emission control areas, called SECAs (SOx Emission Control Areas). Ships entering these areas must use fuel oils with a maximum sulphur content of 1.5% m/m or any other alternative treatment aimed at limiting SOx emissions in order to comply with the values specified. The notation % m/m denotes the mass percentage of a compound relative to the total weight of fuel oil or lubricant composition in which it is included.

Ships sailing trans-continental routes will then use several types of heavy fuel oil depending on local environmental constraints, allowing them to optimize their operating costs. Thus the majority of container ships currently under construction provide for the utilization of several bunker tanks, for a "high sea" fuel oil with a high sulphur content on the one hand and for a 'SECA' fuel oil to with a sulphur content less than or equal to 1.5% m/m on the other hand.

Switching between these two categories of fuel oil can require adaptation of the engine's operating conditions, in particular the utilization of appropriate cylinder lubricants. Currently, in the presence of fuel oil with a high sulphur content (3.5% m/m and more), marine lubricants having a BN of the order of 70 are used. In presence of a fuel oil with a low sulphur content (1.5% m/m and less), marine lubricants having a BN of the order of 40 are used. In these two cases, a sufficient neutralizing capacity is achieved as the necessary concentration in basic sites provided by the overbased detergents of the marine lubricant is reached, but it is necessary to change lubricant at each change of type of fuel oil. Moreover, each of these lubricants has limits of use resulting from the following observations: the use of a cylinder lubricant of BN 70 in the presence of a fuel oil with a low sulphur content (1.5% m/m and less) and at a fixed lubrication level, creates a significant excess of basic sites (high BN) and a risk of destabilization of the micelles of unused overbased detergent, which contain insoluble metallic salts. This destabilization results in the formation of deposits of insoluble metallic salts (for example calcium carbonate), mainly on the piston cover, and can eventually lead to a risk of excessive wear of the jacket-polishing type.

Therefore, the optimization of the cylinder lubrication of a slow-speed two-stroke engine then requires the selection of the lubricant with the BN adapted to the fuel oil and to the operating conditions of the engine. This optimization reduces the flexibility of operation of the engine and requires a significant degree of technical expertise on the part of the crew in defining the conditions under which the switching from one type of lubricant to the other must be carried out. In order to simplify the operations, it would therefore be desirable to have a single cylinder lubricant for two-stroke marine engines which can be used with both high-sulphur content fuel oils and the low-sulphur content fuel oils.

SUMMARY

The purpose of the present invention is to provide a lubricant oil which can ensure good lubrication of the cylinder of a marine engine and which can also cope with the constraints of the high-sulphur content fuel oils and the constraints of the low-sulphur content fuel oils. To this end, the present invention proposes a cylinder lubricant having a BN determined according to the standard ASTM D-2896 greater than or equal to 40 milligrams of potash per gram of lubricant, comprising a lubricant base stock for marine engines and at least one overbased detergent based on alkali metals or alkaline-earth metals, characterized in that it also contains a quantity of 0.01% to 10% preferably 0.1% to 2% by weight relative to the total weight of the lubricant, of one or more (A) compounds chosen from the primary, secondary or tertiary monoalcohols the alkyl or alkylene chain of which is saturated or unsaturated, linear or branched and comprises at least 12 carbon atoms.

Surprisingly, the Applicant has found that the introduction of certain types of surfactant compounds in a conventional formulation for a cylinder lubricant having a determined BN, leads to a significant increase in the effectiveness of said conventional lubricant vis-à-vis neutralization of the sulphuric acid formed during the combustion of any type of fuel oils the sulphur content of which is less than 4.5% in a 2-stroke marine engine. The improvement in performance relates particularly to the neutralization rate or kinetics of the sulphuric acid formed which is appreciably increased. This performance differential, between a conventional reference lubricant and the same lubricant with added surfactant, is characterized by a neutralization effectiveness index measured using the enthalpy test described in the examples below.

Moreover, the Applicant has found that the introduction of these surfactant compounds has no effect, or only a negligible effect on the initial value of the BN of said lubricant measured by the standard ASTM D-2896. In fact, the Applicant has noted that the BN did not appear to be the sole determining criterion for the adaptability of the lubricant to the sulphur content of the fuel oil used. Although it gives an indication of the neutralizing potential, the BN is not necessarily representative of the availability and accessibility of the basic sites constituting the BN vis-à-vis the acid molecules to be neutralized.

Thus without wishing to be bound by any theory, it is possible to envisage that these surfactant compounds do not in themselves provide an additional basicity to the lubricant in which they are placed in solution. On the other hand, their hydrophilic/lipophilic balance (HLB), during their introduction into a lubricant with a given BN, results in an increase in the accessibility of the basic sites contained in the overbased detergents of the lubricant, and therefore an increase in the effectiveness of the reaction neutralizing the sulphuric acid formed during the combustion of the fuel oil. This makes it possible to formulate a cylinder lubricant for a 2-stroke marine engine suitable for both fuel oils with a high sulphur content and for fuel oils with a low sulphur content.

Preferably, the present invention proposes a cylinder lubricant having a determined BN included in range from 40 to 70 milligrams of potash per gram of lubricant, preferably from 50 to 60, or preferably from 50 to 58, or also preferentially equal to 55 milligrams of potash per gram of lubricant. According to an embodiment, the A compounds are chosen from the heavy monoalcohols which have a linear main alkyl chain having 12 to 24 carbon atoms, this linear chain being optionally substituted by one or more alkyl groups having 1 to 23 carbon atoms. Preferably, the A compounds are chosen from myristic, palmitic, cetylic, stearic, eicosenoic, behenic alcohol. Preferably also the A compound is iso-tridecanol.

According to an embodiment the cylinder lubricant comprises one or more functional additives chosen from the dispersant, anti-wear, anti-foam additives, anti-oxidant and/or anti-rust additives. According to an embodiment, the cylinder lubricant comprises at least one overbased detergent chosen from the group constituted by the carboxylates, sulphonates, salicylates, naphthenates, phenates, and the mixed overbased detergents combining at least two of these types of detergents, in particular the cylinder lubricant comprises at least 10% of one or more overbased detergent compounds. According to an embodiment, the overbased detergents are compounds based on metals chosen from the group constituted by calcium, magnesium, sodium or barium, preferentially calcium or magnesium.

According to an embodiment the detergents are overbased by insoluble metallic salts chosen from the group of the carbonates, hydroxides, oxalates, acetates, glutamates of alkali and alkaline-earth metals. Preferably, the overbased detergents are of alkali- or alkaline-earth-metal carbonates or also at least one of the detergents is overbased by calcium carbonate. According to another embodiment, the cylinder lubricant comprises at least 0.1% of a dispersant additive chosen from the family of PIB succinimides. According to another subject the invention relates to the use of a lubricant as described above as a single cylinder lubricant which can be used with any type of fuel oils the sulphur content of which is less than 4.5%, preferably the sulphur content of which is preferably comprised between 0.5 and 4% m/m. Preferably, the single cylinder lubricant can be used both with fuel oils with a sulphur content of less than 1.5% m/m and with fuel oils with a sulphur content greater than 3% m/m.

According to another subject the invention relates to the use of a lubricant as described above for preventing corrosion and/or reducing the formation of deposits of insoluble metallic salts in two-stroke marine engines during the combustion of any type of fuel oil the sulphur content of which is less than 4.5% m/m. According to another subject the invention relates to the use of one or more compounds chosen from the primary, secondary or tertiary monoalcohols the alkyl or alkylene chain of which is saturated or unsaturated, linear or branched and comprises at least 12 carbon atoms, as surfactants in a cylinder lubricant having a BN, measured by the standard ASTM D-2896, greater than or equal to 40 milligrams of potash per gram of lubricant, in order to improve the effectiveness of said cylinder lubricant vis-à-vis the rate of neutralization of the sulphuric acid formed during the combustion of any type of fuel oils the sulphur content of which is less than 4.5% m/m in a two-stroke marine engine. Preferably, the surfactant is present in a quantity of 0.01% to 10% by weight, preferentially from 0.1% to 2% by weight relative to the total weight of the lubricant.

According to another subject the invention relates to a production process for a lubricant as described above to which compound A is added as a separate component of the cylinder lubricant having a BN determined according to the standard ASTM D-2896 greater than or equal to 40 milligrams of potash per gram of lubricant and optionally comprising one or more functional additives. According to an embodiment the lubricant is prepared by dilution of a concentrate of additives for a marine lubricant in which the A compound is incorporated. According to another subject the invention relates to a concentrate of additives for a cylinder lubricant having a BN determined according to the standard ASTM D-2896 greater than or equal to 40 milligrams of potash per gram of lubricant, said concentrate comprising from 0.05% to 20%, preferably from 0.5% to 15%, by weight relative to the total weight of the additive concentrate, of one or more (A) compounds chosen from the primary, secondary or tertiary monoalcohols the alkyl or alkylene chain of which is saturated or unsaturated, linear or branched and comprises at least 12 carbon atoms. According to another embodiment, the concentrate of additive comprises from 15% to 80% by weight relative to the total weight of the concentrate of additive, of one or more (A) compounds chosen from the primary, secondary or tertiary monoalcohols the alkyl or alkylene chain of which is saturated or unsaturated, linear or branched and comprises at least 12 carbon atoms. Preferably in the additive concentrates according to the invention, the heavy monoalcohols have a linear main alkyl chain having 12 to 24 carbon atoms, this linear chain being optionally substituted by one or more alkyl groups having 1 to 23 carbon atoms.

DETAILED DESCRIPTION OF THE EMBODIMENTS OF THE INVENTION

The Heavy Monoalcohols as Surfactants:

The surfactants are molecules having on the one hand a chain with a lipophilic (or hydrophobic) character, and on the other hand a group with a hydrophilic character (or polar head). The heavy monoalcohols used in the invention are non-ionic surfactants the hydrophilic polar head of which is represented by a hydroxyl group OH and the lipophilic part of which is represented by a carbon-containing chain which comprises sufficient carbon atoms to confer a sufficient lipophilic character on the molecule. In the invention, the heavy monoalcohols are used alone or in a mixture and are chosen from the primary, secondary or tertiary monoalcohols the alkyl or alkylene chain of which is saturated or unsaturated, linear or branched and comprises at least 12 carbon atoms.

Moreover, the alkyl chain preferably comprises at the most 60 carbon atoms. Preferably, the alkyl chain comprises from 12 to 50 carbon atoms. It is saturated or in general comprises at the most two ethylene double bond type unsaturations. Preferably, the A compounds contain no aromatic group in their structure.

According to a preferred embodiment, the heavy monoalcohols have a linear main alkyl chain having 12 to 24 carbon atoms, this linear chain being optionally substituted by one or more alkyl groups having 1 to 23 carbon atoms. The monoalcohols used in the invention generally originate from the corresponding fatty acids according to known conversion methods. Preferably, for reasons of cost and availability, fatty acids of vegetable origin are used.

Thus, among the preferred linear monoalcohols there can be mentioned for example the myristic, palmitic, cetylic, stearic, eicosenoic or behenic alcohols originating from the corresponding fatty acids. Among the preferred branched monoalcohols there can be mentioned for example iso-tridecanol. In a preferred embodiment of the invention, monoalcohols with a linear alkyl chain comprising an even number of carbon atoms comprised between 12 and 24 carbon atoms will be used.

Due to their weak surfactant properties or their strong lipophilic character, these compounds are stabilized in solution in the oil matrix and have a tendency to shift the chemical equilibrium within the overbased detergents. Therefore the basic sites provided by the overbased detergents are more accessible which makes the reaction of neutralizing the sulphuric acid by these basic sites provided by the overbased detergents more effective.

It is moreover noted that these compounds do not in themselves provide an additional basicity to the lubricant in which they are placed in solution. The quantities of surfactants used in the invention range from 0.01% to 10% by weight relative to the total weight of the lubricant. It is possible to use a compound or a mixture of several compounds chosen from the monoalcohols defined above. As the viscosity or the gelling level of the final lubricant can vary according to the nature of the heavy monoalcohol or monoalcohols chosen, a quantity comprised within the range from 0.1% to 2% by weight of one or more monoalcohols relative to the total weight of the lubricant will preferably be used. It is thus possible to retain a viscosity grade in compliance with the specifications for use for the final marine lubricant according to the invention.

BN of the Lubricants According to the Present Invention:

The BN of the lubricants according to the present invention is provided by the overbased detergents based on alkali metals or alkaline-earth metals. The value of this BN measured according to ASTM D-2896 can vary from 5 to 100 mg KOH/g in marine lubricants. A lubricant with a fixed BN value is chosen according to the conditions of use of said lubricants and in particular according to the sulphur content of the fuel oil used and in combination with the cylinder lubricants. The lubricants according to the present invention are adapted to a use such as cylinder lubricant, whatever the sulphur content of the fuel oil used as fuel in the engine. Therefore the cylinder lubricants for two-stroke marine engines according to the invention have a BN greater than or equal to 40, preferentially comprised between 40 and 70, or also between 50 and 60, or also between 50 and 58, or also equal to 55.

According to a preferred embodiment of the invention, the formulation of lubricant has a BN level, measured according to the standard ASTM D-2896, intermediate between the levels required for the limited sulphur contents of the fuel oils commonly used, i.e. a BN comprised between 50 and 60, preferably between 50 and 58, preferentially equal to 55. The latter is coupled with a formulation including heavy monoalcohol type surfactants, allowing increased accessibility of the basic sites provided by overbased detergents, in order to neutralize the acid in as effective a manner as the conventional formulations with a higher BN.

For example, a lubricant formulation according to the invention having a BN of 55 will have at least the same effectiveness in neutralizing the sulphuric acid as a conventional formulation with a BN of 70. The conventional oils with a BN of 55, thus reformulated according to the invention make it possible to correctly prevent the problems of corrosion during the use of high-sulphur fuel oils (of the order of 3% m/m). An oil according to the present invention also allows a reduction in the formation of deposits of insoluble metallic salts providing the overbasing (for example $CaCO_3$) during the use of fuel oils with a low sulphur content (1.5% m/m and less), this reduction is directly linked to the lowering of the BN made possible in the present configuration of the formulation.

Moreover, the lubricants according to the present invention retain a sufficient detergency capability when they are formulated for a use both with fuel oils with a low and high sulphur content, since their BN (and therefore the quantity of detergents present) can be fixed at an intermediate level between that required for the two categories of fuel oils. Preferably, the lubricants according to the present invention are neither in the form of an emulsion nor a microemulsion.

The Overbased Detergents:

The overbased detergents used in the lubricant compositions according to the present invention are well known to a person skilled in the art. The detergents commonly used in the formulation of lubricant compositions are typically anionic compounds comprising a long lipophilic hydrocarbon-containing chain and a hydrophilic head. The associated cation is typically a metallic cation of an alkali or alkaline-earth metal.

The detergents are preferentially chosen from the salts of alkali or alkaline-earth metals of carboxylic acids, sulphonates, salicylates, naphthenates, as well as the salts of phenates. The alkali or alkaline-earth metals are preferentially calcium, magnesium, sodium or barium. These metallic salts can contain the metal in an approximately stoichiometric quantity or in excess (in a quantity greater than the stoichiometric quantity). In the latter case, we are dealing with so-called overbased detergents.

The excess metal providing the detergent with its overbased character is presented in the form of insoluble metallic salts in the oil, for example carbonate, hydroxide, oxalate, acetate, glutamate, preferentially carbonate. In the same overbased detergent, the metals of these insoluble salts can be the same as those of oil-soluble detergents or different. They are preferentially chosen from calcium, magnesium, sodium or barium. The overbased detergents are thus presented in the form of micelles composed of insoluble metallic salts maintained in suspension in the lubricant composition by the detergents in the form of oil-soluble metallic salts. These micelles can contain one or more types of insoluble metallic salts, stabilises by one or more detergent types.

The overbased detergents comprising a single type of detergent-soluble metallic salt are generally named according to the nature of the hydrophobic chain of the latter detergent. Thus, they are said to be of phenate, salicylate, sulphonate, naphthenate type according to whether this detergent is respectively a phenate, salicylate, sulphonate, or naphthenate. The overbased detergents are said to be of mixed type if the micelles comprise several types of detergents, which differ from each other by the nature of their hydrophobic chain.

For a use in the lubricant compositions according to the present invention, the oil-soluble metallic salts are preferentially calcium, magnesium, sodium or barium phenates, sulphonates, salicylates, and mixed phenate-sulphonate and/or salicylate detergents. According to a preferred embodiment of the present invention, the insoluble metal salt providing the overbased character is calcium carbonate. The overbased detergents used in the lubricant compositions according to the present invention are preferentially phenates, sulphonates, salicylates and mixed phenate—sulphonate—salicylate detergents, overbased with calcium carbonate.

According to an embodiment of the present invention, at least 10% of one or more overbased detergent compounds, providing the lubricant with basicity in a quantity sufficient to neutralize the acids formed during the combustion are used. The quantity of overbased detergents is determined in a standard fashion in order to reach the target BN.

The Base Stocks:

In general, the base stocks used for the formulation of lubricants according to the present invention can be oils of mineral, synthetic or vegetable origin as well as their mixtures. The mineral or synthetic oils generally used in the application belong to one of the classes defined in the API classification as summarized below:

| | Saturates content | Sulphur content | Viscosity index |
|---|---|---|---|
| Group 1 Mineral oils | <90% | >0.03% | 80 ≤ VI < 120 |
| Group 2 Hydro-cracked oils | ≥90% | ≤0.03% | 80 ≤ VI < 120 |
| Group 3 Hydro-isomerized oils | ≥90% | ≤0.03% | ≥120 |
| Group 4 | PAO | | |
| Group 5 | Other bases not included in bases of groups 1 to 4 | | |

The mineral oils of Group 1 can be obtained by distillation of selected naphthenic or paraffinic crudes, then purification of these distillates by processes such as extraction with solvent, dewaxing with solvent or catalyst, hydrotreating or hydrogenation. The oils of Groups 2 and 3 are obtained by stricter purification processes, for example a combination of hydrotreating, hydrocracking, hydrogenation and catalytic dewaxing. The examples of synthetic bases of Group 4 and 5 include the poly-alpha olefins, polybutenes, polyisobutenes, alkylbenzenes. These base stocks can be used alone or in mixture. A mineral oil can be combined with a synthetic oil.

The cylinder oils for 2-stroke marine diesel engines have a viscosity grade of SAE-40 to SAE-60, generally SAE-50 equivalent to a kinematic viscosity at 100° C. comprised between 16.3 and 21.9 $mm^2/s$. This viscosity can be obtained by a mixture of additives and base stocks for example containing the mineral bases of Group 1 such as Neutral Solvent bases (for example 500 NS or 600 NS) and Brightstock. Any other combination of bases of mineral, synthetic or vegetable origin having, in a mixture with the additives, a viscosity compatible with the grade SAE-50 can be used.

Typically, a standard cylinder lubricant formulation for slow-speed 2-stroke marine diesel engines is grade SAE 40 to SAE 60, preferentially SAE 50 (according to the classification SAE J300) and comprises at least 50% by weight of lubricant base stock of mineral and/or synthetic origin, suited to use in marine engines, for example, of class API Group 1, i.e. obtained by distillation of selected crudes, then purification of these distillates by processes such as extraction with solvent, dewaxing with solvent or catalyst, hydrotreating or hydrogenation. Their Viscosity Index (VI) is comprised between 80 and 120; their sulphur content is greater than 0.03% and their saturate content is less than 90%.

The Functional Additives:

The lubricant formulation according to the present invention can also contain functional additives suited to their use, for example dispersant additives, anti-wear, anti-foam additives, anti-oxidant and/or anti-rust additives. The latter are known to a person skilled in the art. These additives are generally present in a content by weight of 0.1 to 5%.

Dispersant Additives:

Dispersants are well-known additives used in the formulation of a lubricant composition, in particular for application in the marine field. Their first role is to maintain in suspension the particles initially present or appearing in the lubricant composition during its use in the engine. They prevent their agglomeration by taking advantage of steric hindrance. They can also have a synergetic effect on neutralization.

The dispersants used as additives for a lubricant typically contain a polar group, associated with a relatively long hydrocarbon-containing chain, generally containing from 50 to 400 carbon atoms. The polar group typically contains at least one nitrogen, oxygen or phosphorus element. The compounds derived from succinic acid are dispersants particularly used as lubrication additives. In particular the succinimides obtained by condensation of succinic anhydrides and amines, the succinic esters obtained by condensation of succinic anhydrides and alcohols or polyols are used. These compounds can then be treated with various compounds in particular sulphur, oxygen, formaldehyde, carboxylic acids and compounds containing boron or zinc for producing for example borated succinimides or zinc-blocked succinimides.

Mannich bases, obtained by polycondensation of phenols substituted by alkyl, formaldehyde and primary or secondary amine groups, are also compounds used as dispersants in the lubricants. According to an embodiment of the present invention, at least 0.1% of a dispersant additive is used. A dispersant in the family of the PIB succinimides can be used, for example, borated or zinc-blocked.

Other Functional Additives:

The lubricant compositions according to the present invention can also optionally contain other additives. For example anti-wear additives can be mentioned, which can for example be chosen from the family of zinc dithiophosphates, anti oxidant/anti-rust additives, for example organometallic or thiadiazole detergents, and anti-foam additives to counter the effect of the detergents, and can be, for example, polar polymers such as polymethylsiloxanes, polyacrylates.

According to the present invention, the compositions of the lubricants described relate to the compounds taken separately before mixing, it being understood that said compounds can or cannot retain the same chemical form before and after mixing. Preferably, the lubricants according to the present invention obtained by mixing the compounds taken separately are not in the form of an emulsion or a microemulsion.

The surfactant compounds contained in the lubricants according to the present invention can in particular be incorporated in a lubricant as a separate additive, for example, to increase the effectiveness of neutralization of a standard lubricant formulation which is already known. The surfactants according to the invention are in this case preferably included in a standard cylinder lubricant formulation for slow 2-stroke marine diesel engines of grade SAE 40 to SAE 60, preferentially SAE 50 (according to the classification SAE J300).

This standard formulation comprises:

at least 50% by weight of lubricant base stock of mineral and/or synthetic origin, suitable for use in a marine engine, for example, class API Group 1 i.e. obtained by distillation of selected crudes then purification of these distillates by processes such as extraction with a solvent, dewaxing with a solvent or catalyst, hydrotreatment or hydrogenation. Their Viscosity Index (VI) is comprised between 80 and 120; their sulphur content is greater than 0.03% and their saturate content less than 90%;

at least 10% of one or more overbased detergent compounds, providing the lubricant with basicity in a quantity sufficient to neutralize the acids formed during combustion, which can for example be chosen from detergents of the sulphonate, phenate, salycilate type;

at least 0.1% of a dispersant additive which can, for example, be chosen from the family of PIB succinimides, and the primary function of which is to maintain in suspension the particles initially present or appearing in the lubricant composition during its use in the engine; it also has a synergic effect on the neutralization;

and optionally anti-foam, anti-oxidant, and/or anti-rust, and/or anti-wear agents such as for example those of the family of zinc dithiophosphates. All the mass percentages expressed relate to the total weight of the lubricant composition.

Concentrates of Additives for Marine Lubricants:

The surfactant compounds contained in the lubricants according to the present invention can also be included in a concentrate of additives for marine lubricant. The concentrates of additives for marine cylinder lubricants are generally constituted by a mixture of the constituents described above, detergents, dispersants, other functional additives, pre-dilution base sock, in proportions making it possible to obtain, after dilution in a base stock, cylinder lubricants having a BN determined according to the standard ASTM D-2896 greater than or equal to 40 milligrams of potash per gram of lubricant. This mixture generally contains, in relation to the total weight of concentrate, a detergent content greater than 80%, preferably greater than 90%, a dispersant additive content of 2 to 15%, preferably 5 to 10%, a content of other functional additives of 0 to 5% preferably of 0.1 to 1%.

According to a subject of the invention, the concentrate of additives for a marine lubricant comprises one or more surfactant agents in a proportion making it possible to obtain a quantity of surfactant in the cylinder lubricant according to the invention of 0.01% to 10%, preferably 0.1 to 2%. Thus, the concentrate of additives for a marine lubricant contains, in relation to the total weight of concentrate, preferably 0.05% to 20%, preferably 0.5 to 15% by weight of one or more (A) compounds chosen from primary, secondary or tertiary monoalcohols, the alkyl or alkylene chain of which is saturated or unsaturated, linear or branched and comprises at least 12 carbon atoms.

According to an embodiment, the additive concentrates for a cylinder lubricant contains from 0.05 to 80%, preferably of 0.5 to 50% or also 2% to 40% or also 6% to 30% or also 10 to 20% by weight relative to the total weight of the additive concentrate, one or more (A) compounds chosen from primary, secondary or tertiary monoalcohols, the alkyl or alkylene chain of which is saturated or unsaturated, linear or branched and comprises at least 12 carbon atoms. According to a particular embodiment, the concentrate of additives contains 15% to 80% by weight relative to the total weight of the additive concentrate, of one or more (A) compounds as defined above. All these % are expressed by weight relative to the total weight of the concentrate which also contains base stock in a small quantity, but sufficient to facilitate implementation of said concentrate of additives.

Measurement of the Performance Differential Between a Conventional Reference Lubricant and a Lubricant According to the Invention:

This measurement is characterized by a neutralization effectiveness index measured according to the enthalpy test method precisely described in the examples and in which the progress of the exothermic neutralization reaction is monitored by the increase in temperature observed when the lubricant containing the basic sites is placed in the presence of sulphuric acid.

Of course, the present invention is not limited to the examples and the embodiment described and represented, but it can have numerous variants which are within the reach of a person skilled in the art.

EXAMPLES

Example 1

This Example describes the enthalpy test making it possible to measure the effectiveness of neutralizing the lubricants vis-à-vis sulphuric acid. The availability or accessibility of the basic sites included in a lubricant, in particular a cylinder lubricant for a 2-stroke marine engine, vis-à-vis the acid molecules, can be quantified by a dynamic monitoring test of the neutralization rate or kinetics.

Principle:

Acid-base neutralization reactions are generally exothermic and it is therefore possible to measure the generation of heat obtained by reacting sulphuric acid with the lubricants to be tested. This heat generation is monitored by temperature evolution over time in a DEWAR type adiabatic reactor. Starting from these measurements, it is possible to calculate an index quantifying the effectiveness of a lubricant with additives according to the present invention compared with a lubricant taken as reference.

This index is calculated with respect to the reference oil to which the value of 100 is given. This is the ratio between the neutralization reaction times of the reference ($S_{ref}$) and of the measured sample ($S_{mes}$):

$$\text{Neutralization effectiveness index}=S_{ref}/S_{mes}\times 100$$

The values of these neutralization reaction times, which are of the order of a few seconds, are determined from the acquisition curves of the temperature increase as a function of time during the neutralization reaction. (see curve in FIG. 1). The time period S is equal to the difference $t_f-t_i$ between the time at the end-of-reaction temperature and the time at the start-of-reaction temperature. The time $t_i$ at the start-of-reaction temperature corresponds to the first temperature increase after stirring has been started. The time $t_f$ at the final temperature of the reaction is that starting from which the temperature signal remains stable for a period of time greater than or equal to half of the reaction time. The lubricant is thus even more effective in that it leads to short neutralization times and therefore to a high index.

Equipment Used:

The geometries of the reactor and the stirrer as well as the operating conditions were chosen so that they are situated in the chemical regime, where the effect of the diffusion constraints in the oil phase is negligible. Thus in the configuration of the equipment used, the height of fluid must be equal to the internal diameter of the reactor, and the stirrer screw must be positioned at approximately ⅓ of the height of the fluid. The apparatus is constituted by a cylindrical-type 250 ml adiabatic reactor, of which the internal diameter is 48 mm and the internal height 150 mm, with a stirring rod provided with a screw with inclined blades, 22 mm in diameter; the diameter of the blades is comprised between 0.3 and 0.5 times the diameter of the DEWAR, i.e. from 9.6 to 24 mm. The position of the screw is fixed at a distance of 15 mm from the bottom of the reactor. The stirring system is driven by a motor with at a variable speed of 10 to 5000 r.p.m. and a system for acquiring the temperature as a function of time.

This system is suitable for measuring reaction times of the order of 5 to 20 seconds and for measuring a temperature increase of several tens of degrees starting from a temperature of approximately 20° C. to 35° C., preferably approximately 30° C. The position of the system for acquiring the temperature in the DEWAR is fixed. The stirring system is set such that the reaction takes place in the chemical regime: in the configuration of the present experiment, the speed of rotation is set at 2000 r.p.m, and the position of the system is fixed. Moreover, the chemical regime of the reaction is also dependent on the height of the oil introduced into the DEWAR, which must be equal to the diameter of the latter, and which correspond within the framework of this experiment to a mass of 70 g of the lubricant tested.

3.5 g of 95% sulphuric acid concentrate and 70.0 g of lubricant to be tested are introduced into the reactor. After placing the stirring system inside the reactor such that the acid and the lubricant are well mixed and in a manner which is repeatable over two tests, the acquisition system then the stirring are started in order to monitor the reaction. 3.5 g of acid is introduced into the reactor. Then 70.0 g of lubricant is introduced and heated to a temperature of approximately 30° C. The acquisition system is then started, then the stirring system is adjusted so as to be situated in the chemical regime.

Implementation of the Enthalpy Test—Calibration:

In order to calculate the effectiveness indices of the lubricants according to the present invention by the method described above, we have chosen to take as a reference the neutralization reaction time measured for a two-stroke marine engine cylinder oil of BN 70 (measured by ASTM D-2896), which does not contain any surfactant additive according to the present invention. This oil is obtained from a mineral base obtained by mixing a distillate with a density at 15° C. comprised between 880 and 900 Kg/m$^3$ with a distillation residue with a density comprised between 895 and 915 Kg/m$^3$ (Brightstock) in a ratio distillate/residue of 3.

A concentrate including a calcium sulphonate of BN equal to 400 mg of KOH/g, a dispersant, a calcium phenate of BN equal to 250 mg of KOH/g is added to this base in a quantity necessary to obtain a lubricant of BN 70 mg of KOH/g. The lubricant thus obtained has a viscosity at 100° C. comprised between 19 and 20.5 mm$^2$/s. The neutralization reaction time of this oil (referred to below as Href) is 10.3 seconds and its neutralization effectiveness index is fixed at 100.

Two other samples of lubricant of BN 55 and 40 are prepared from the same concentrate of additives diluted respectively with 1.25 and 1.7 according to the desired BN and a lubricant base in which the mixture of distillate and residue is adjusted in order to obtain finally a viscosity at 100° C. comprised between 19 and 20.5 mm$^2$/s. These two samples, referred to below as H55 and H40, are also free of surfactant additives according to the present invention.

Table 1 below gives the values for the neutralization indices obtained for the samples of BN 40 and 55 prepared by dilution of the additives included in the reference oil of BN 70.

TABLE 1

| | BN | Neutralization effectiveness index |
|---|---|---|
| Href | 70 | 100 |
| H 55 | 55 | 88 |
| H 40 | 40 | 77 |

Example 2

This, example describes the influence of the additives according to the invention for a formulation at a constant BN of 55. The reference is the BN 70 two-stroke marine engine cylinder oil, without additives according to the present invention, and referenced Href in the previous example.

The samples with additives BN 55 to be tested are prepared starting from the lubricant without additives reference H 55 in the previous example. These samples are obtained by mixture in a beaker at a temperature of 60° C., under stirring which is sufficient to homogenize the mixture of the lubricant H55 which can have additives added and the chosen surfactant. For a mixture of content x % m/m of surfactant:

x g of surfactant are introduced it is completed up to 100 g with the lubricant H55 which can have additives added.

Table 2 below shows the values for the effectiveness indices of the various samples prepared in this way.

The BN of the lubricants before and after introduction of the surfactants according to the present invention have also been measured according to standard ASTM D-2896.

TABLE 2

| Lubricant without additive | Additives (empirical formula) | (% m/m) | Neutralization effectiveness index | BN (mg KOH/g) |
|---|---|---|---|---|
| Href | | | 100 | 68.6 |
| H 55 | | | 88 | 55.4 |
| | Lorol C12 (C10: 0-2%; C12: <98%; C16: 0-2%) | 0.5% | 93 | 56.7 |
| | Lorol C14 (C12: 0-5%; C14: 95-100%; C16: 0-3%) | 0.5% | 110 | 56.5 |
| | Lorol C16 (C14: 0-3%; C16: <95%; C18: 0-5%) | 0.5% | 107 | 56.1 |
| | Lorol Technish <C12: 0-3%; (C12: 48-58; C14: 18-24%; C16: 8-12%; C18: 11-15%; >C18: 0-1%) | 0.1% | 91 | 54.7 |
| | Lorol Technish | 1% | 98 | 54.7 |
| | Cetylic alcohol (C16H34O) 95% mini | 0.5% | 117 | 54.5 |

TABLE 2-continued

| Lubricant without additive | Additives (empirical formula) | (% m/m) | Neutralization effectiveness index | BN (mg KOH/g) |
|---|---|---|---|---|
| | Cetylic alcohol (C16H34O) | 1% | 127 | 54.3 |
| | Stearic alcohol (C18H38O) 96% mini | 0.1% | 109 | 55.0 |
| | Stearic alcohol (C18H38O) | 0.5% | 115 | 56.6 |
| | Stearic alcohol (C18H38O) | 1% | 117 | 54.0 |
| | Eicosanol (C20H42O) 96% mini | 0.1% | 99 | 54.6 |
| | Eicosanol (C20H42O) | 0.5% | 122 | 56.8 |
| | Eicosanol (C20H42O) | 1% | 117 | 54.3 |
| | Stenol (C16: 0-0.3%; C18: 0-3%; C20: 12-17%: C22: 80-85%; C24: 0-3%) | 0.1% | 109 | 54.6 |
| | Stenol | 0.5% | 113 | 54.6 |

It is noted that the lubricants with additives according to the present invention have, at BN 55, a neutralization effectiveness index greater than that of the same oil of BN 55 which has not had additives added in this way. Nearly all the oils of BN 55 with additives according to the present invention have a neutralization effectiveness index greater than that of an oil of BN 70 which has not had additives added in this way, taken as reference. The index values for the oils of BN 55 according to the present invention are overall from 9 to 27% greater than the reference, even though the introduction of the additives according to the present invention has had no influence on the value of their BN.

The invention claimed is:

1. A cylinder lubricant having a BN determined according to the standard ASTM D-2896 in the range from 50 to 58 milligrams of potash per gram of lubricant, comprising:

a lubricant base stock for marine engines; and at least one overbased detergent based on alkali metals or alkaline-earth metals, said overbased detergent being selected from the group consisting of sulphonates, and phenates, wherein said cylinder lubricant also contains a quantity of 0.1 to 2% by weight relative to the total weight of the lubricant, of one or more (A) compounds selected from the group consisting of primary monoalcohols, wherein said monoalchohol has an alkyl chain that is saturated, said alkyl chain being linear and comprising between 12 and 24 carbon atoms.

2. The cylinder lubricant according to claim 1 in which the (A) compound or compounds are selected from the group consisting of myristic, palmitic, cetylic, stearic, and behenic alcohols.

3. The cylinder lubricant according to claim 1 which comprises one or more functional additives selected from the group consisting of dispersant, anti-wear, anti-foam additives, anti-oxidant and/or anti-rust additives.

4. The cylinder lubricant according to claim 1 which comprises at least 10% by weight relative to the total weight of the cylinder lubricant of one or more overbased detergent compounds.

5. The cylinder lubricant according to claim 1 in which the overbased detergents are metal-based compounds selected from the group consisting of calcium, magnesium, sodium, and barium.

6. The cylinder lubricant according to claim 1 in which the detergents are overbased by insoluble metallic salts selected from the group consisting of carbonates, hydroxides, oxalates, acetates, glutamates of alkali or alkaline-earth metals.

7. The cylinder lubricant according to claim 1 in which the overbased detergents are carbonates of alkali or alkaline-earth metals.

8. The cylinder lubricant according to claim 4 in which at least one of the detergents is overbased by calcium carbonate.

9. The cylinder lubricant according to claim 1 which comprises at least 0.1% by weight relative to the total weight of the cylinder lubricant of a dispersant additive chosen from the family of the PIB succinimides.

10. A method of lubricating a cylinder in a two-stroke engine combusting a fuel oil, the method comprising contacting the cylinder with a lubricant according to claim 1, wherein the fuel oil comprises a sulphur content of less than 4.5% m/m.

11. A method of lubricating a cylinder in a two-stroke engine combusting a fuel oil, the method comprising contacting the cylinder with a lubricant according to claim 1, wherein the fuel oil comprises a sulphur content of less than 1.5% m/m or greater than 3% m/m.

12. A method for preventing corrosion and/or reducing the formation of deposits of insoluble metallic salts in two-stroke marine engines during the combustion of any type of fuel oil the sulphur content of which is less than 4.5% m/m, the method comprising contacting a cylinder in the two-stroke marine engine with a cylinder lubricant according to claim 1.

13. A method of improving the effectiveness of a cylinder lubricant vis-a-vis the rate of neutralization of the sulphuric acid formed during the combustion of any type of fuel oils the sulphur content of which is less than 4.5% m/m in a two-stroke marine engine, the method comprising adding, as surfactants in a cylinder lubricant having a BN, measured by the standard ASTM D-2896, in the range from 50 to 58 milligrams of potash per gram of lubricant, one or more (A) compounds selected from the group consisting of the primary monoalcohols, wherein said monoalcohol has an alkyl chain that is saturated, said alkyl chain being linear and comprising between 12 and 24 carbon atoms and wherein said surfactant agent is present in a quantity of 0.1 to 2% by weight relative to the total weight of the cylinder lubricant.

14. The method according to the claim 13 wherein the (A) compound or compounds are selected from the group consisting of myristic, palmitic, cetylic, stearic, eicosenoic, and behenic alcohols.

15. A production process for a lubricant according to claim 1 in which the (A) compound is added as a separate component of the cylinder lubricant having a BN determined according to the standard ASTM D-2896 in the range from 50 to 58 milligrams of potash per gram of lubricant and optionally comprising one or more functional additives.

16. A production process for a lubricant according to claim 1 by dilution of a concentrate of additives for a marine lubricant into which the (A) compound is incorporated.

17. A cylinder lubricant having a BN determined according to the standard ASTM D-2896 in the range from 50 to 58 milligrams of potash per gram of lubricant comprising:

a lubricant base stock for marine engines; and at least one overbased detergent based on alkali metals or alkaline-earth metals; said overbased detergent being selected from the group consisting of sulphonates, and phenates and the alkali metals or alkaline-earth metal of said overbased detergent being compounds selected from the group consisting of calcium, magnesium, sodium and barium; and wherein said cylinder lubricant also contains a quantity of 0.1 to 2% by weight relative to the total weight of the lubricant, of one or more (A) compounds selected from the group consisting of primary monoalcohols, wherein said monoalcohol has an alkyl chain that is saturated, said alkyl chain being linear and comprises between 12 carbon atoms and 24 carbon atoms.

* * * * *